United States Patent [19]

Kalyandurg

[11] Patent Number: 4,956,674

[45] Date of Patent: Sep. 11, 1990

[54] METERING ASSEMBLY FOR DEVELOPMENT APPARATUS

[75] Inventor: Satyan K. Kalyandurg, Rochester, N.Y.

[73] Assignee: Eastman Kodak Company, Rochester, N.Y.

[21] Appl. No.: 400,191

[22] Filed: Aug. 29, 1989

[51] Int. Cl.[5] ..... G03G 15/09

[52] U.S. Cl. ..... 355/251; 355/253

[58] Field of Search ..... 355/251, 253, 260, 245

[56] References Cited

U.S. PATENT DOCUMENTS 4,671,207 6/1987 Hilbert ..... 355/253 X
4,699,495 10/1987 Hilbert ..... 355/253
4,748,471 5/1988 Adkins ..... 355/253

*Primary Examiner*—A. T. Grimley
*Assistant Examiner*—Sandra L. Hoffman
*Attorney, Agent, or Firm*—Milton S. Sales

[57] ABSTRACT

Apparatus for applying developer material to a latent electrostatic image wherein flow of developer material is controlled accurately and without clogging. A rotary feed mechanism delivers developer material from a sump to a magnetic brush, and includes a drive mechanism axially aligned with and drivingly engaged with the feed mechanism. A metering device between the sump and the magnetic brush rotates about an axis substantially co-axial with the rotary feed mechanism between (1) an open position communicating the magnetic brush and the sump and (2) a closed position substantially isolating the magnetic brush from the sump. A drive solenoid is spaced from the metering device, and the drive mechanism is positioned axially between the solenoid and the metering device. The metering device is drivingly connected to the solenoid while at the same time avoiding interference with said drive mechanism since the connecting means extends radially outwardly around the drive mechanism.

3 Claims, 2 Drawing Sheets

METERING ASSEMBLY FOR DEVELOPMENT APPARATUS

CROSS-REFERENCE TO RELATED APPLICATIONS

Reference is made to copending, commonly assigned U.S. Pat. application Ser. No. 289,147, filed Dec. 23, 1988, in the name of B. J. Joseph.

TECHNICAL FIELD

This invention relates generally to development apparatus for applying developer material to a latent image in an electrostatographic reproduction apparatus, and more particularly to an improved developer material regulating apparatus for assuring reliable control over the flow of developer material in such apparatus.

BACKGROUND ART

Magnetic brush development apparatus for applying developer material to a latent image in an electrostatographic reproduction apparatus are well known in the art. Such apparatus may include a housing having a sump portion which contains a mixture of carrier particles and pigmented marking particles. The material in the sump is agitated to triboelectrically charge the material prior to delivering it to a magnetic brush where it can be brought into association with, and electrostatically transferred to, an electrostatic latent image to develop such image.

Copending, commonly assigned U.S. Pat. application Ser. No. 289,147, filed Dec. 23, 1988, in the name of B. J. Joseph discloses a ribbon blender that is used for agitating (mixing), feeding and triboelectrically charging developer material in the sump portion of a magnetic brush development apparatus, and a feed mechanism that delivers material from the sump portion to a magnetic brush under the control of a metering assembly that includes a closeable slot between the sump and the magnetic brush. Although the metering assembly disclosed by Joseph has been found to operate satisfactorily, toner clogging at the slot can be further reduced by the metering assembly of the present invention.

DISCLOSURE OF INVENTION

This invention is directed to an improved magnetic brush development apparatus for applying developer material to a latent electrostatic image wherein flow of developer material is controlled accurately and without clogging.

According to the present invention, apparatus for applying developer material to a latent electrostatic image includes a housing having a sump for containing a supply of developer material, a magnetic brush in the housing and spaced from said sump, and a feed mechanism between the sump and the magnetic brush. The feed mechanism has rotary means for receiving developer material from the sump and for delivering such material to said magnetic brush. It further includes a drive mechanism axially aligned with and drivingly engaged with the rotary means. There are metering means between the sump and the magnetic brush mounted for rotation about an axis substantially co-axial with the rotary means for movement between (1) an open position communicating the magnetic brush and the sump and (2) a closed position substantially isolating the magnetic brush from the sump. Drive means are spaced from the metering means, and the drive mechanism is positioned axially between the drive means and the metering means. The metering means is drivingly connected to the drive means while at the same time avoiding interference with said drive mechanism since the connecting means extends radially outwardly around the drive mechanism.

In accordance with a preferred embodiment of the present invention, the means for drivingly connecting the metering means to the drive means comprises an armature which extends radially beyond the drive mechanism, a lever drivingly connected to the drive means for rotation thereby, a rotatable coupler, a connector rod extending between the lever and the coupler so that rotation of the lever by the drive means is translated into arcuate movement of the coupler, and an arm which projects axially around the drive mechanism to the coupler.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

Figure 1:
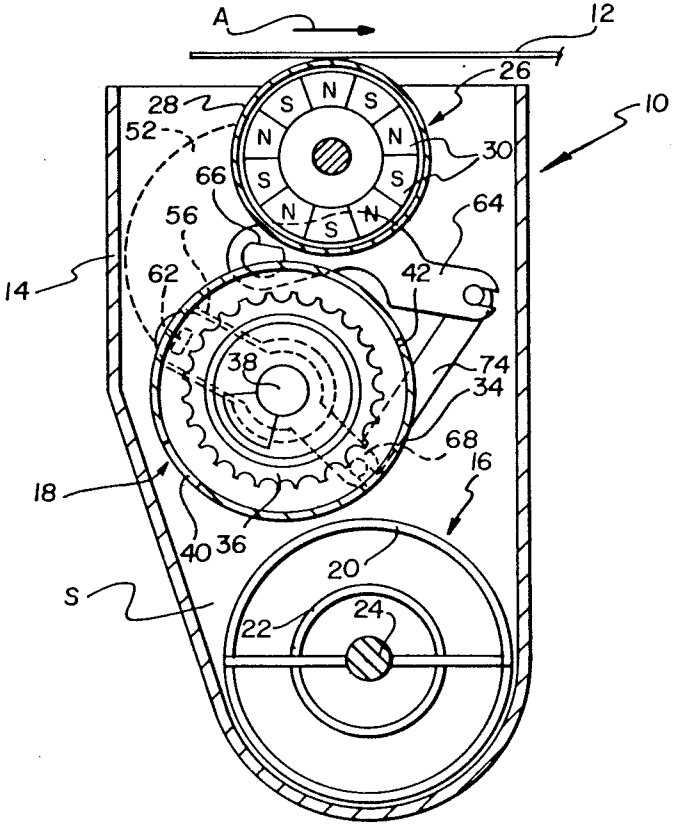
FIG. 1 is an end elevational view, partly in cross-section, of magnetic brush development apparatus of the present invention.

Referring now to the accompanying drawings, FIG. 1 shows a magnetic brush development apparatus according to this invention, generally designated by the numeral 10. Apparatus 10 is adapted to provide a supply of developer material, including pigmented marking particles, to an electrostatic latent image carried by a member 12 in order to develop the latent image on the member. Member 12, which is for example part of an electrostatographic reproduction apparatus, is in the form of an endless web or a drum, or can be discrete sheets on which a copy is formed. Member 12 is moved past apparatus 10 in the direction shown by an arrow "A" during development of the latent image on the member.

Apparatus 10 comprises a housing 14, the lower portion of which defines a sump "S" for containing a supply of developer material. The developer material in sump S is agitated by a ribbon blender 16 in order to provide triboelectric charging of the developer material, move the material along the length of the sump, and deliver developer material to a feed mechanism 18. Ribbon blender 16 comprises an outer helical ribbon 20 and an inner helical ribbon 22. Both ribbons are coiled concentrically about a shaft 24 concentrically located with respect to the semi-cylindrical bottom wall of housing 14.

A magnetic brush, generally designated by the numeral 26, is located at the top of housing 14. Magnetic brush 26 may be of any suitable construction, such as illustrated for example in FIG. 1 where the magnetic brush includes a shell 28 of a non-magnetic material that rototes counterclockwise about a plurality of permanent magnets 30 rotatable in a clockwise direction as viewed in FIG. 1. A portion of magnetic brush 26 projects through the top of housing 14 and lies directly underneath electrostatic latent image carrying member 12.

Feed mechanism 18 is located between magnetic brush 26 and ribbon blender 16. Feed mechanism 18 receives developer material driven by ribbon blender 16 and transports such material to the magnetic brush through a metering tube 34, discussed below. Feed mechanism 18 comprises a shell 36 rotatable in a clockwise direction about an axis designated by the numeral 38. Within shell 36 there is a stationary magnet that extend about 85 degrees clockwise from a position generally directly above ribbon blender 16 to a position just ahead of alignment with magnetic brush 26. Developer material from the sump is attracted to shell 36 and held to the shell in the area under the influence of the magnets. Thus the material can be transported from the sump to the magnetic brush without dropping from the shell.

Figure 2:
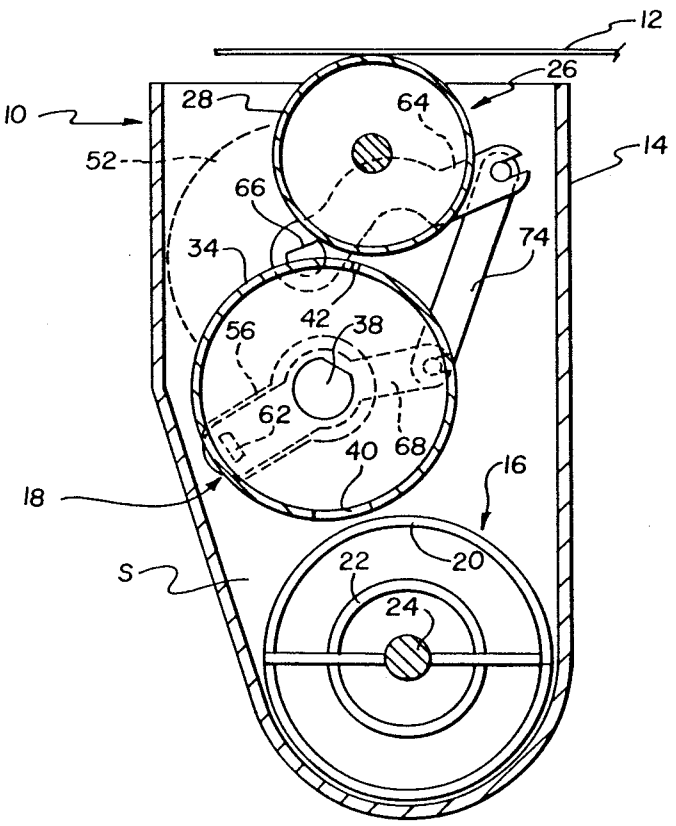
FIG. 2 is a view similar to FIG. 1 showing parts in a different orientation.

A metering assembly includes elongate, generally cylindrical metering tube 34 that extends substantially the full length of the magnetic brush and surrounds shell 36. A pair of opposed slots 40 and 42 extend substantially the length of metering tube 34, which is mounted so that it can be selectively rotated about its axis between its position illustrated in FIG. 1 and a position shown in FIG. 2. In its FIG. 2 position, slot 40 and 42 are aligned with blender 16 and magnetic brush 26 so that development material can flow through slot 40 to shell 36, and then through slot 42 to the magnetic brush. In its FIG. 1 position, the slots are not aligned with the blender and the magnetic brush, thereby preventing the passage of developer material to the magnetic brush.

Figure 3:
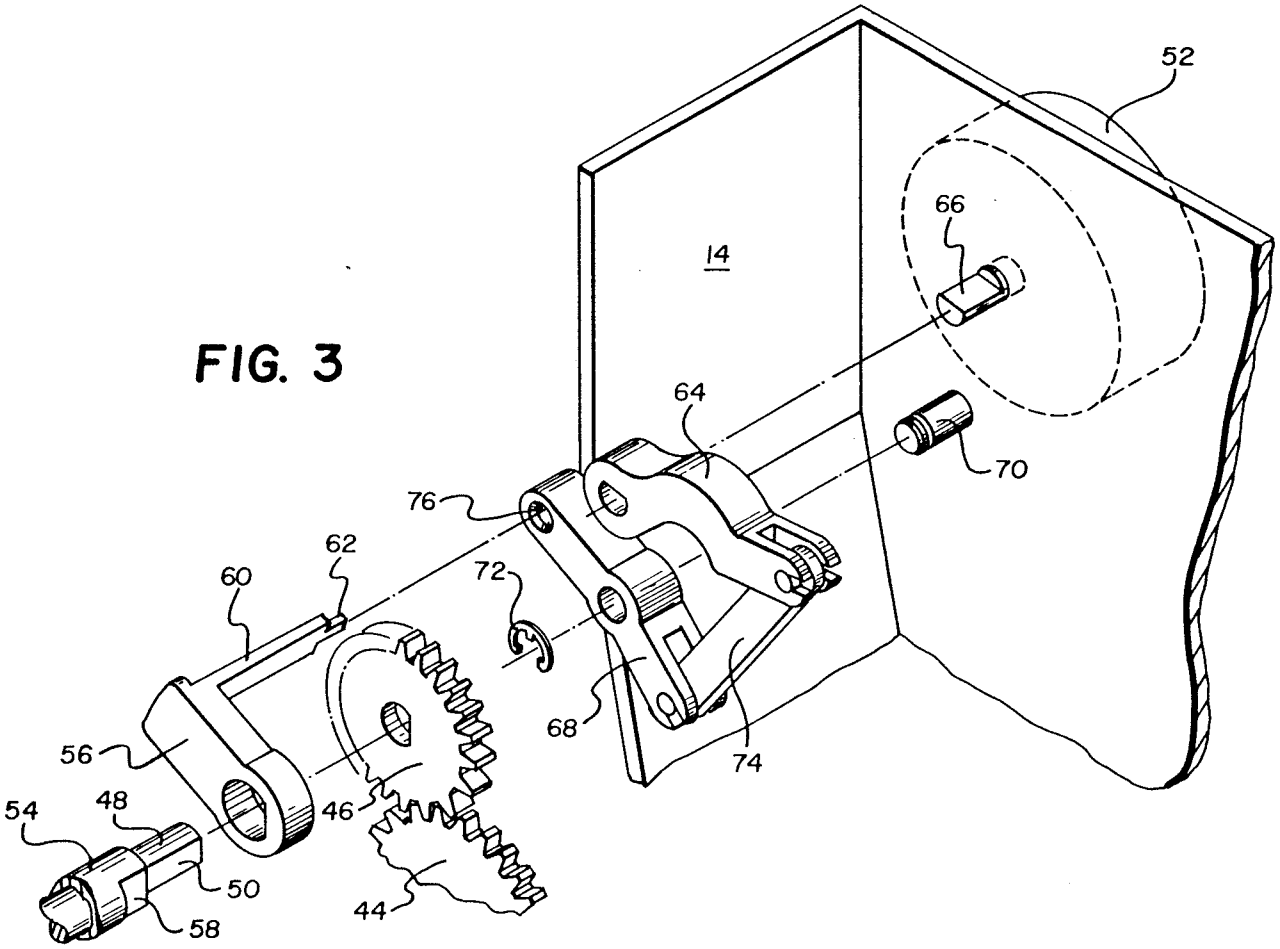
FIG. 3 is an enlarged perspective view of a portion of the apparatus of FIGS. 1 and 2 showing parts in exploded form.

Shell 36 is driven through a gear train 44 and 46, which is best seen in FIG. 3. Gear 46 is drivingly connected to a shaft 48 by a flat 50 to drive the shell. On the otherhand, metering tube is rotated by a rotary solenoid 52 coupled by a series of linkages, to be described in detail, to a collar 54, which is free to rotate about shaft 48.

Figure 4:
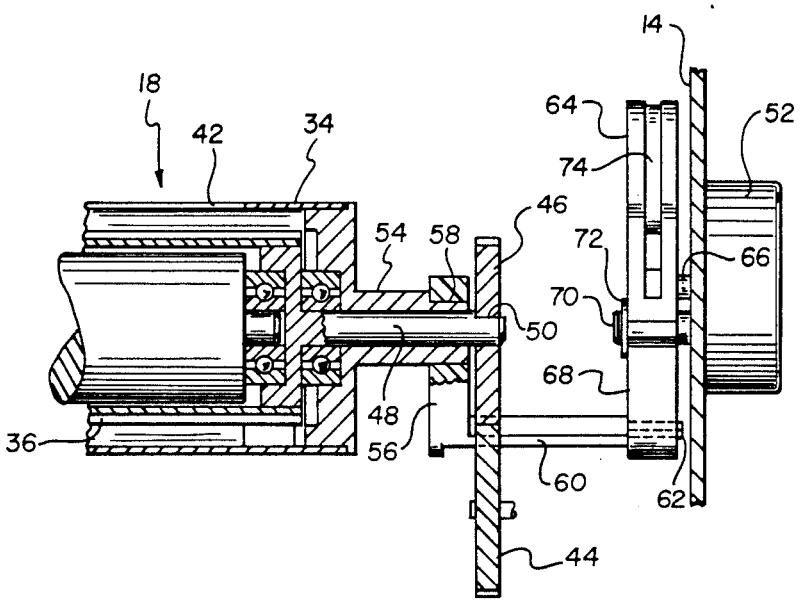
FIG. 4 is a side elevational view of the apparatus of FIGS. 1 and 2, partially in section 3.

It will be appreciated best from FIGS. 3 and 4 that gears 44 and 46 are located between collar 54 and solenoid 52, making direct coupling between the solenoid and shell 34 impractical. According to the present invention, provision has been made for drivingly connecting shell 34 to the solenoid while at the same time avoiding interference with the gears, converting the angular rotation of commercially available solenoids to the needed angular rotation of the shell, and providing for easy assembly.

An armature 56 is drivingly mounted on a flat 58 of collar 54. Armature 56 extends radially beyond gear 46, and has an arm 60 which projects axially around the gear train and terminates in a post 62.

At the other end of the connection between solenoid 52 and shell 34, a lever 64 is drivingly connected to the solenoid shaft by a flat 66 on the shaft. A coupler 68 is rotatably held on a post 70 by an E-ring 72. A connector rod 74 extends between an end of lever 64 and coupler 68 so that rotation of the lever by solenoid 52 is translated into arcuate movement of the opposed end of the coupler.

During assembly, post 62 on arm 60 of armature 56 is aligned with a hole 76 of coupler 68, and the entire feed mechanism 18 is slid into axial position, with post 62 entering hole 76. The ease of assembly will be apparent to the reader.

The invention has been described in detail with particular reference to preferred embodiments thereof, but it will be understood that variations and modifications can be effected within the spirit and scope of the invention.

What is claimed is:

1. Apparatus for applying developer material to a latent electrostatic image; said apparatus comprising:

a housing having a sump for containing a supply of developer material;

a magnetic brush in said housing and spaced from said sump;

a feed mechanism between said sump and said magnetic brush, said feed mechanism including (1) rotary means for receiving developer material from said sump and for delivering such material to said magnetic brush and (2) a drive mechanism axially aligned with and drivingly engaged with said rotary means;

metering means between said sump and said magnetic brush, said metering means being mounted in said housing for rotation, about an axis substantially co-axial with said rotary means for movement between (1) an open position communicating the magnetic brush and the sump and (2) a closed position substantially isolating the magnetic brush from the sump;

drive means outside said housing and spaced from said metering means, said drive mechanism being positioned axially between said drive means and said metering means;

means for drivingly connecting said metering means to said drive means while at the same time avoiding interference with said drive mechanism, said connecting means extending radially outwardly around said drive mechanism.

2. An improved magnetic brush development apparatus as defined in claim 1 wherein said feed mechanism means includes a rotatable, generally cylindrical shell and a plurality of magnets within the shell for attracting developer material to a portion of the shell.

3. Apparatus for applying developer material to a latent electrostatic image; said apparatus comprising:

a housing having a sump for containing a supply of developer material;

a magnetic brush in said housing and spaced from said sump;

a feed mechanism between said sump and said magnetic brush, said feed mechanism including (1) rotary means for receiving developer material from said sump and for delivering such material to said magnetic brush and (2) a drive mechanism axially aligned with and drivingly engaged with said rotary means:

metering means between said sump and said magnetic brush, said metering means being mounted in said housing for rotation, about an axis substantially co-axial with said rotary means for movement between (1) an open position communicating the magnetic brush and the sump and (2) a closed position substantially isolating the magnetic brush from the sump;

drive means spaced from said metering means, said drive mechanism being positioned axially between said drive means and said metering means;

means for drivingly connecting said metering means to said drive means while at the same time avoiding interference with said drive mechanism, said connecting means extending radially outwardly around said drive mechanism wherein said means for drivingly connecting said metering means to said drive means comprises:

an armature drivingly mounted to said metering means, said armature extending radially beyond said drive mechanism;

a lever drivingly connected to said drive means for rotation thereby;

a rotatable coupler;

a connector rod extending between said lever and said coupler so that rotation of the lever by said drive means is translated into arcuate movement of said coupler; and an arm which projects axially around the drive mechanism to said coupler.

* * * * *